US005785209A

United States Patent [19]

Guglielmini

[11] Patent Number: 5,785,209

[45] Date of Patent: Jul. 28, 1998

[54] TAMPERPROOF CAP WITH POURER

[75] Inventor: Bernard Guglielmini, Crimolois, France

[73] Assignee: Rical S.A., Longvic Cedex, France

[21] Appl. No.: 898,006

[22] Filed: Jul. 25, 1997

Related U.S. Application Data

[63] Continuation of Ser. No. 452,434, May 26, 1995, abandoned.

[30] Foreign Application Priority Data

Jun. 1, 1994 [FR] France ..... 94 06711

[51] Int. Cl.[6] ..... B65D 47/10

[52] U.S. Cl. ..... 222/153.07; 222/541.9; 222/556

[58] Field of Search ..... 222/153.07, 541.6, 222/541.9, 556

[56] References Cited

U.S. PATENT DOCUMENTS

| | | | |
|---|---|---|---|
| 3,459,315 | 8/1969 | Labarre | 222/541.9 |
| 3,817,416 | 6/1974 | Costa | 222/153.07 X |
| 4,487,324 | 12/1984 | Ostrowsky | 215/253 |
| 4,984,716 | 1/1991 | Beck | 222/541.9 X |

FOREIGN PATENT DOCUMENTS

| | | | |
|---|---|---|---|
| A-0 009 525 | 4/1980 | European Pat. Off. . | |
| A-0 052 059 | 5/1982 | European Pat. Off. . | |
| 0214095 | 3/1987 | European Pat. Off. | 222/556 |
| A-0 564 755 | 10/1993 | European Pat. Off. . | |
| A-2 297 778 | 8/1976 | France . | |
| A-2 556 693 | 6/1985 | France . | |
| A-2 637 570 | 4/1990 | France . | |
| 3212359 | 9/1991 | Japan | 222/541.9 |
| 2 151 216 | 7/1985 | United Kingdom . | |
| 2193193 | 2/1988 | United Kingdom | 222/541.9 |

*Primary Examiner*—Joseph Kaufman
*Attorney, Agent, or Firm*—Beveridge, DeGrandi, Weilacher & Young, LLP

[57] ABSTRACT

A tamperproof cap with pourer for closing the neck of a container having an exterior attachment flange includes a fixing ring with an interior bead for attachment to the exterior flange on the neck of the container, a stopper hinged to the ring, and a tear-off tamperproof strip joining the stopper to the ring until the stopper is opened for the first time. The fixing ring, the stopper and the tamperproof strip are molded in one piece from plastics material. A pourer member is fitted into cap and fits to the neck of the container when the cap is fitted to the neck so that the hinged stopper co-operates with the pourer spout of the pourer member.

6 Claims, 4 Drawing Sheets

TAMPERPROOF CAP WITH POURER

This application is a continuation, of application Ser. No. 08/452,434, filed May 26, 1995, now abandoned which application is entirely incorporated herein by reference.

BACKGROUND OF THE INVENTION

1. Field of the Invention

The present invention concerns a tamperproof cap for capping the neck of a container incorporating an external attachment flange. The cap incorporates a pourer.

2. Description of the Prior Art

A prior art cap of this type comprises a fixing ring with an interior bead for attaching it to the external flange on the neck of the container, a stopper and a tear-off tamperproof strip joining the stopper to the ring until the cap is opened for the first time. In addition to these three components, which are molded in one piece from plastics material, the cap comprises a pourer member which fits to the neck of the container and with which the cap co-operates in order to close the container.

After the tamperproof strip is torn off this prior art cap, the stopper is free, i.e. it is no longer joined to the ring, and so may be mislaid once removed. Also, some users can find it difficult to close the container again using a stopper of this kind.

The present invention is directed to a tamperproof cap which remedies the drawbacks of the prior art caps and which incorporates a pourer.

The invention is also directed to a tamperproof cap which incorporates a pourer and in which the stopper remains joined to the ring for fixing the cap to the neck of the container and is held in a stable open position.

SUMMARY OF THE INVENTION

The tamperproof cap of the invention is adapted to close the neck of a container incorporating an exterior attachment flange. The cap comprises a fixing ring with an interior bead for attachment to the external flange on the neck of the container. It further comprises a stopper hinged to said ring. It additionally comprises a tear-off tamperproof strip joining the stopper to the ring until the stopper is opened for the first time. The fixing ring, the stopper and the tamperproof strip are molded in one piece from plastics material. The cap further comprises a pourer member which fits to the neck of the container when the cap is fitted to the neck of the container so that the hinged stopper co-operates with the pourer spout of the pourer member.

The pourer member and the capsule can advantageously be made separately, in which case the pourer member is fitted into the cap before the latter is fitted to the neck of the container.

The stopper preferably comprises a skirt which fits into the pourer spout of the pourer member.

The height of the pourer member is advantageously such that the skirt of the stopper bears on the spout of the pourer member when the stopper is in the open position, which holds the stopper in a stable open position.

To this end the skirt of the stopper can if necessary have on the hinge side of the stopper a height that is greater than its height around the remainder of its perimeter.

The pourer member can advantageously comprise flow-rate regularizing means, of cruciform shape, for example.

One illustrative and non-limiting embodiment of a cap with pourer of the invention is described in more detail below with reference to the appended drawings.

DETAILED DESCRIPTION OF THE PREFERRED EMBODIMENT

Figure 1:
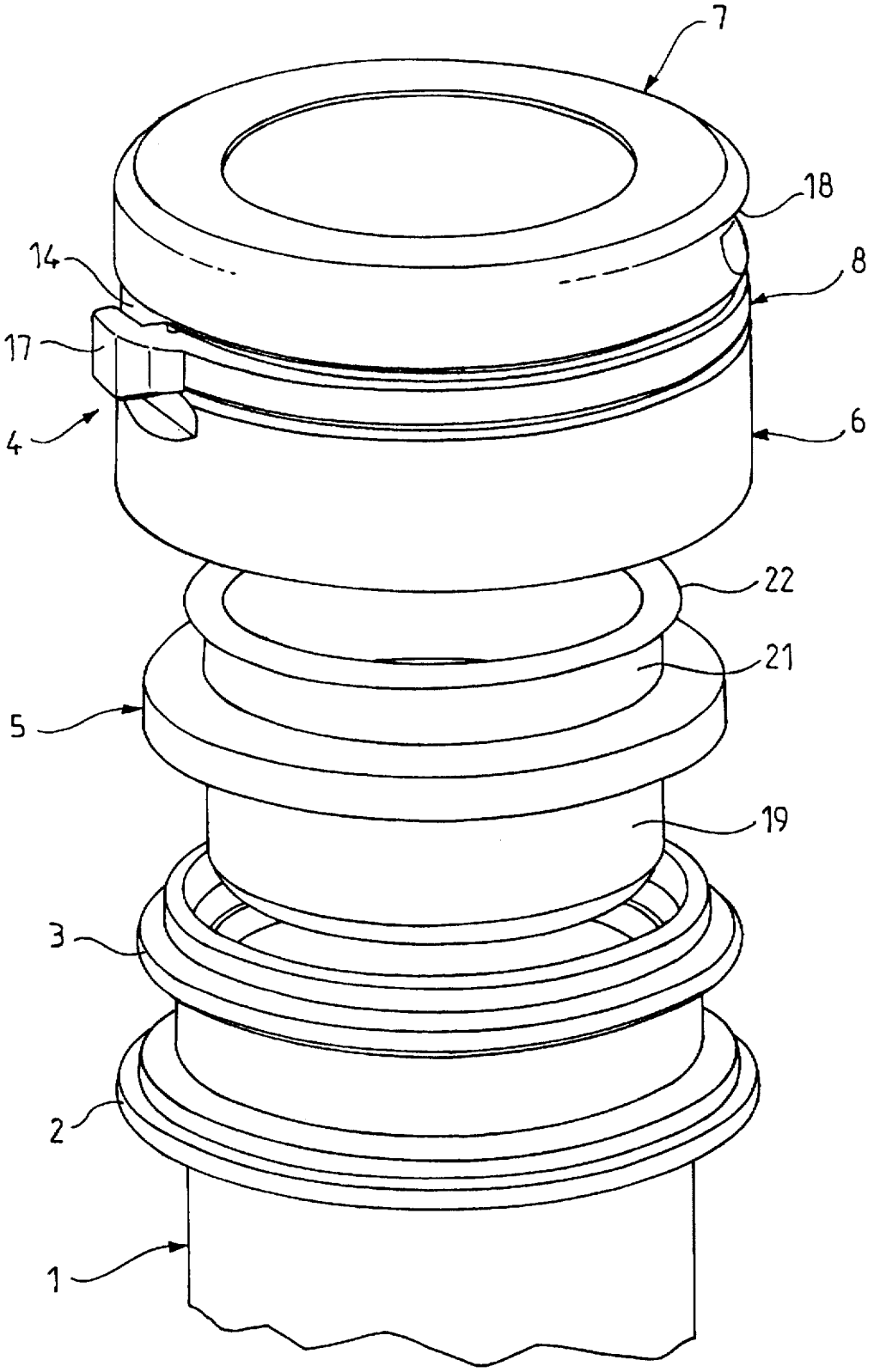
FIG. 1 is an exploded perspective view of the cap, the pourer member and the neck of the container receiving the cap with the pourer member.
Figure 2:
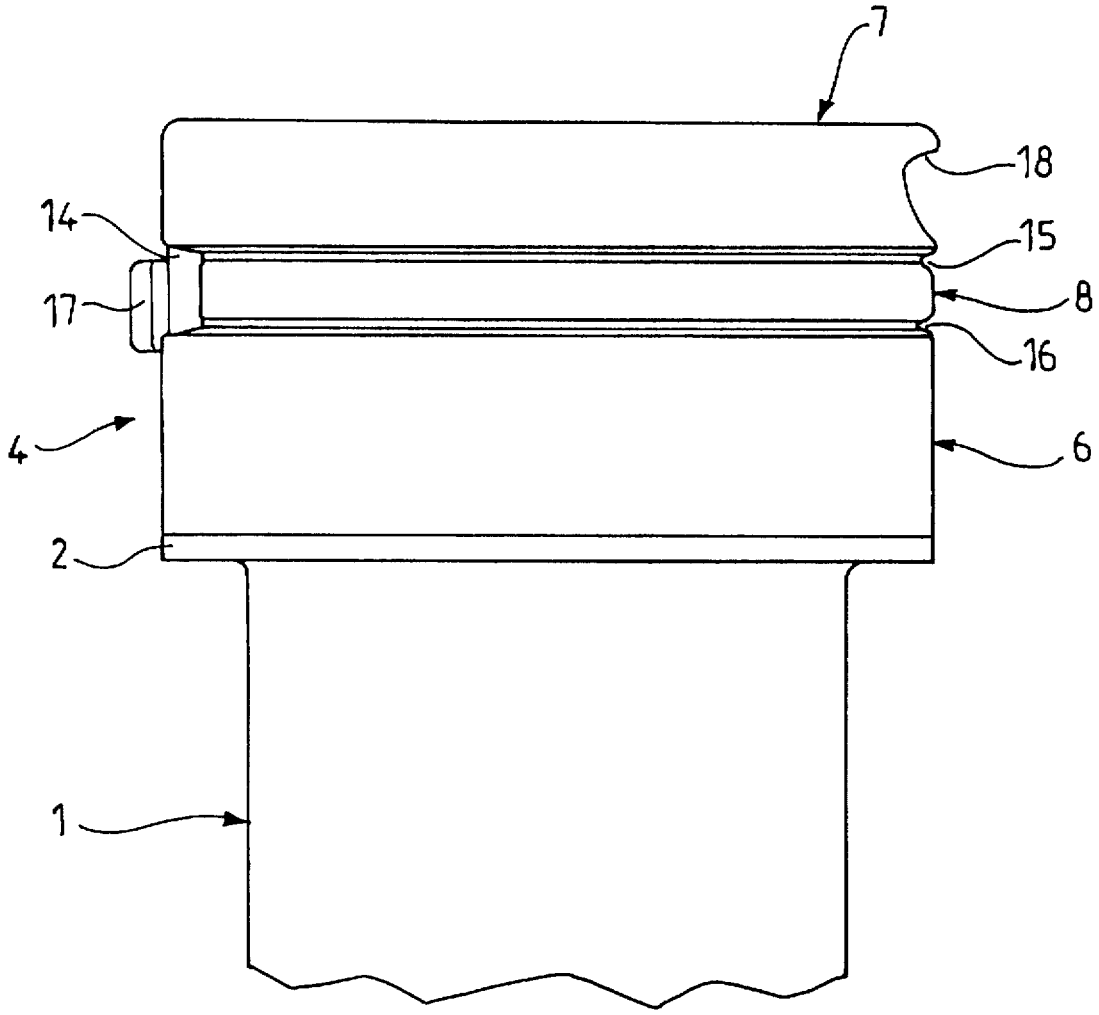
FIG. 2 is an exterior view of the cap fixed to the neck of the container, in the closed position.

Referring to FIG. 1, a container that is not shown in detail, for example a PET (polyethylene teraphtalate) bottle, has a neck 1 with an external flange 2 which provides a support during fitting of the cap and an attachment flange 3 above the support flange 2.

The neck 1 is closed by a cap 4 which is associated with a pourer member 5.

The cap 4 and the pourer member 5 can be made separately, in which case the pourer member 5 is advantageously inserted into the cap 4 from below before the cap is fitted to the neck 1 of the container.

Figure 3:
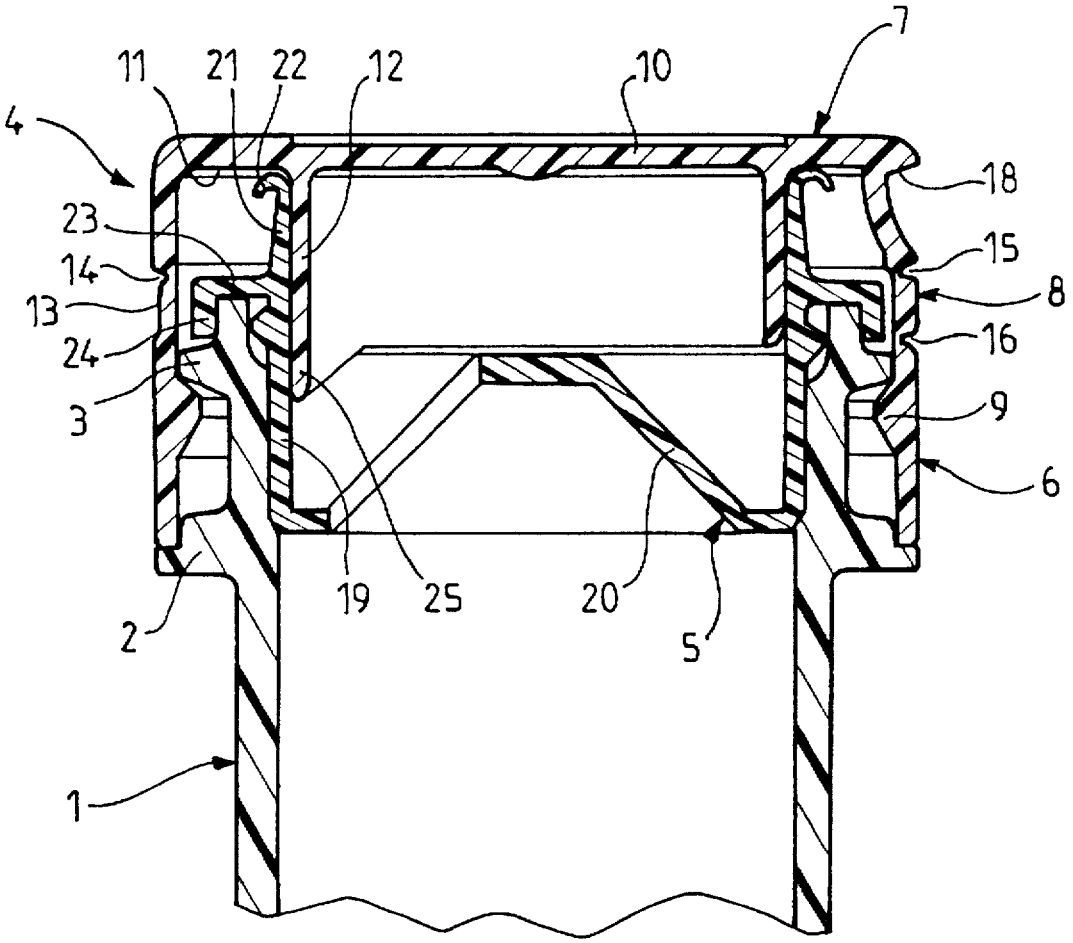
FIG. 3 is an axial section through the cap and the pourer member in position on the neck of the container, in the closed position shown in FIG. 2.

As shown in FIG. 3 in particular, the cap 4 comprises a fixing ring 6, a stopper 7 and a tear-off tamperproof strip 8.

The ring 6 has a bead 9 on the inside which clips under the attachment ring 3 on the neck 1 of the container.

The stopper 7 comprises a disk 10 defining an annular bearing surface 11 around a cylindrical sealing skirt 12. The stopper 7 is joined to the ring 6 at one point on its external perimeter by a lug 13 including a thinner part 14 forming a hinge perpendicular to the axis of the cap.

The tamperproof strip 8 connects the stopper 7 to the ring 6 around all of its perimeter, except at the location of the lug 13, and therefore at the hinge 14, with two tear lines 15, 16, for example thin webs or rows of spaced fragile connecting bridges.

To make it easier to tear off, the strip 8 has a tab 17 for holding it at one end, to one side of the lug 13 and the hinge 14.

To make it easier to open, the stopper 7 has a tab 18 on the side opposite the hinge 14.

The pourer member 5 comprises a generally cylindrical skirt 19 having a flowrate regulating cross 20 at its lower end. The skirt 19 is extended in the upward direction by a pourer spout 21 having an exterior lip 22 at its upper end. Between the skirt 19 and the spout 21 the pourer member 5 includes a flange 23 projecting radially outwards and ending at a downwardly facing rim 24.

Before the cap 4 is fitted to the neck 1 of the container, the pourer member 5, which is manufactured separately from the cap 4, is inserted into the cap from below, so that the spout 21 nests over the skirt 12 of the stopper 7 and the flange 23 is retained behind the bead 9 on the ring 6.

When the combination of the cap 4 and the pourer member 5 is fitted to the neck 1 of the container, the skirt 19 of the pourer member 5 enters the neck, its flange 23 with the rim 24 nesting over the upper edge of the neck, above the attachment flange 3.

After the cap 4 and the pourer member 5 have been clipped onto the neck 1 of the container, the interior bead 9 on the ring 6 being clipped behind the flange 3 on the neck of the container, the cap 4 closes the neck of the container in a tamperproof manner so long as the tamperproof strip 8 has not been torn off.

Figure 4:
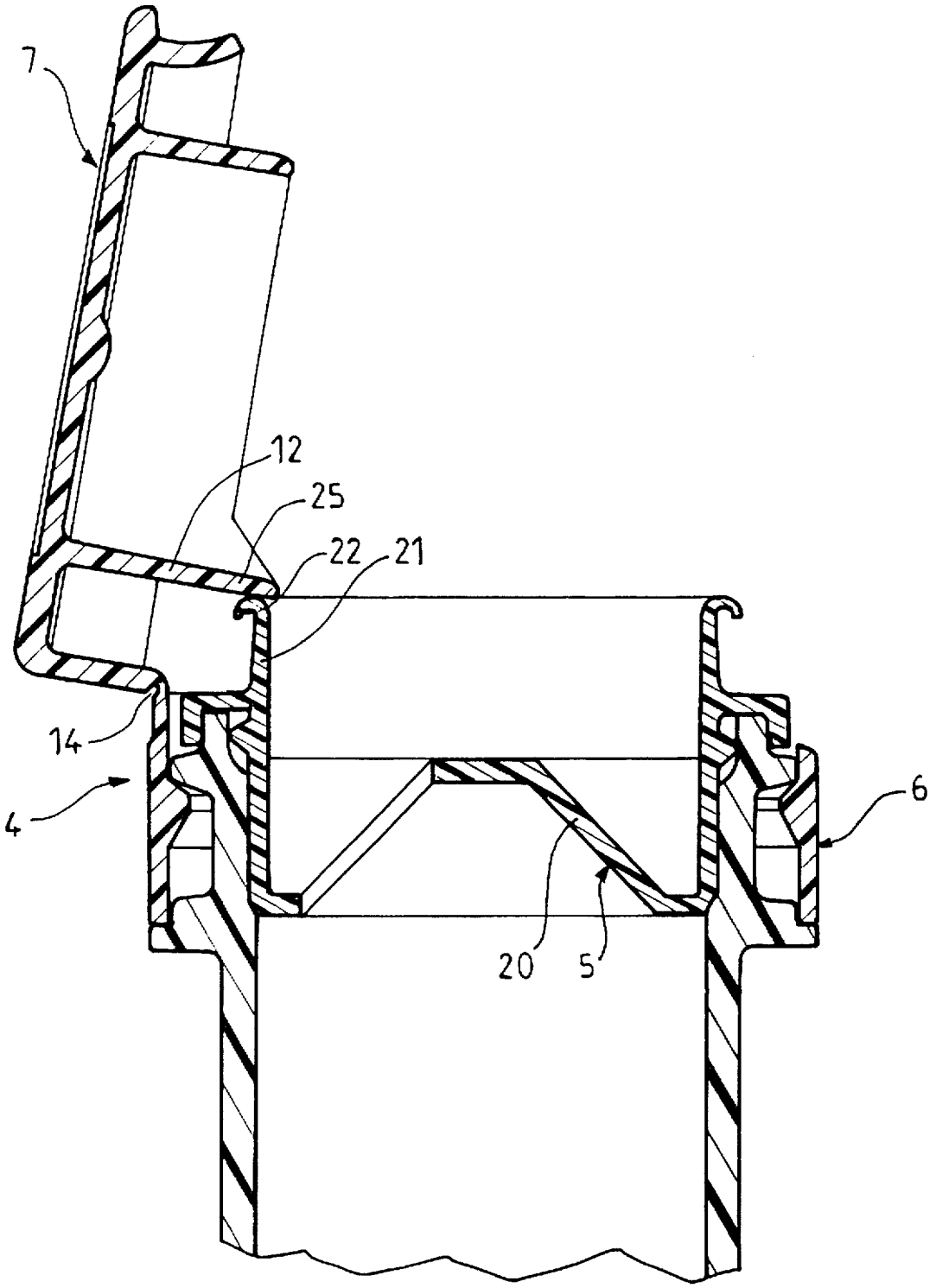
FIG. 4 is an axial section analogous to FIG. 3 but after the tamperproof strip is torn off and after the stopper is opened.

After the strip 8 has been torn off the stopper 7 remains attached to the ring 6 by the hinge 14 and can be opened by pivoting it about this hinge, as shown in FIG. 4.

To hold the stopper 7 in a stable open position at an angle of more or less 90° to the closed position, the skirt 12 of the stopper 7 must bear on the upper edge (outside rim 22) of the pourer spout 21 when the stopper is in the open position. This implies conformance with a number of constraints regarding the relative dimensions of the length of the skirt 12, the height of the hinge 14 relative to the end of the skirt 12, the diameter of the skirt 12 relative to the outside diameter of the stopper 7, the radial distance of the hinge 14 from the skirt 12, the length of the pourer spout 21 and the height of the hinge 14 relative to the upper end (rim 22) of the spout 21.

In particular, the vertical distance between the upper end of the spout 21 and the hinge 14 must be equal to, less than or greater than the radial distance between the hinge 14 and the spout 21 according to whether the stopper 7 when in the open position must be at 90°, less than 90° or at more than 90° to the closed position.

As shown in FIGS. 3 and 4, to make the stopper 7 easier to close, i.e. to facilitate insertion of the skirt 12 into the spout 21 on the side opposite the hinge 14, the skirt 12 can be relatively short and extended by a part 25 only in the area nearest the hinge 14, to enable it to bear on the spout 21 in the open position.

The cap 4 as a whole (ring 6, stopper 7 and tamperproof strip 8), on the one hand, and the pourer member 5, on the other hand, can be made from different materials and/or different colours, since they are manufactured separately.

There is claimed:

1. Tamperproof cap and pourer assembly for closing a neck of a container having an exterior attachment flange, the assembly comprising:

a cap including i) a fixing ring with an interior bead for attaching said cap to said exterior flange of said neck of said container, ii) a stopper having a disk portion and a substantially cylindrical sealing skirt extending from said disk portion, said stopper being hinged to said ring, and iii) a tear-off tamperproof strip joining said stopper to said ring along all of a perimeter of said stopper except for a location where said stopper is hinged to said ring, said fixing ring, said stopper and said tamperproof strip being molded in one piece from plastics material; and a pourer member having a pourer spout defining an opening therein through which material to be poured can pass from one side of said pourer member to an opposite side of said pourer member, the pourer member being manufactured separately from said cap and being fitted into said cap so as to fit to said neck of said container when said cap is fitted to said neck, said pourer spout of said pourer member and said sealing skirt each having a length and diameter and being positioned relative to said location where said stopper is hinged to said ring such that said sealing skirt of said stopper fits into said pourer spout in a closed position of said stopper so as to seal said opening, and a portion of the sealing skirt rests on an upper end of said pourer spout in an open position of said stopper to hold said stopper stably in an open position.

2. Tamperproof cap and pourer assembly according to claim 1 wherein said sealing skirt has, on a same side as said location where said stopper is hinged to said ring, a first height which is greater than a second height of the sealing skirt along a remainder of a perimeter of said sealing skirt.

3. Tamperproof cap and sourer assembly according to claim 1 wherein said pourer member and said cap are made from different materials.

4. Tamperproof cap and pourer assembly according to claim 1 wherein said pourer member includes flowrate regulating means.

5. Tamperproof cap and pourer assembly according to claim 4 wherein said flowrate regulating means is cross-shaped.

6. Tamperproof cap and pourer assembly according to claim 1 wherein said pourer member and said cap are different colors.

* * * * *